United States Patent [19]

Wilson

[11] Patent Number: 4,890,993

[45] Date of Patent: Jan. 2, 1990

[54] APPARATUS FOR FORMING CONCRETE STRUCTURES

[76] Inventor: T. Woodrow Wilson, S. 1600 Dishman-Mica Rd., Spokane, Wash. 99206-3356

[21] Appl. No.: 141,980

[22] Filed: Jan. 11, 1988

[51] Int. Cl.[4] ..... E04G 11/40

[52] U.S. Cl. ..... 425/63; 52/88; 52/320; 249/11; 249/20; 249/31; 249/180; 249/185; 264/32; 264/35

[58] Field of Search ..... 249/1, 10, 11, 13, 19, 249/20, 21, 28, 31, 83, 176, 180, 181, 185, 209; 425/62, 63; 264/31, 32, 35; 52/86, 88, 320, 324, 745

[56] References Cited

U.S. PATENT DOCUMENTS

| | | | |
|---|---|---|---|
| 959,167 | 5/1910 | Rice | 425/63 |
| 1,248,643 | 12/1917 | Furry | 249/209 |
| 1,293,006 | 2/1919 | Brynoldt | 249/1 |
| 2,020,519 | 11/1935 | Sarosdy | 249/11 |
| 4,150,808 | 4/1979 | Sawyer | 249/191 |

FOREIGN PATENT DOCUMENTS

| | | | |
|---|---|---|---|
| 1020175 | 11/1957 | Fed. Rep. of Germany | 52/88 |

*Primary Examiner*—James C. Housel
*Attorney, Agent, or Firm*—Keith S. Bergman

[57] ABSTRACT

A primary forming member is associated with a secondary supporting structure to allow rapid construction of elongate concrete structures of uniform cross-section by removing the primary forming member before the concrete mass supported by the secondary supporting structure is set or self-supporting. The primary forming member provides plural spaced forming arches, foldable for transport, and supported for vertical motion on a carriage providing for horizontal motion along the axis of symmetry of the formed structure. The primary forming member supports a plurality of spaced support arches of the secondary supporting structure with a plurality of cross elements therebetween to support rigid panels that create a forming surface for plastic concrete and remain as a part of a formed concrete structure to provide insulation. The forming system forms a self-supporting arched concrete surface with spaced depending arches by being sequentially moved axially therealong.

5 Claims, 4 Drawing Sheets

FIG. 1
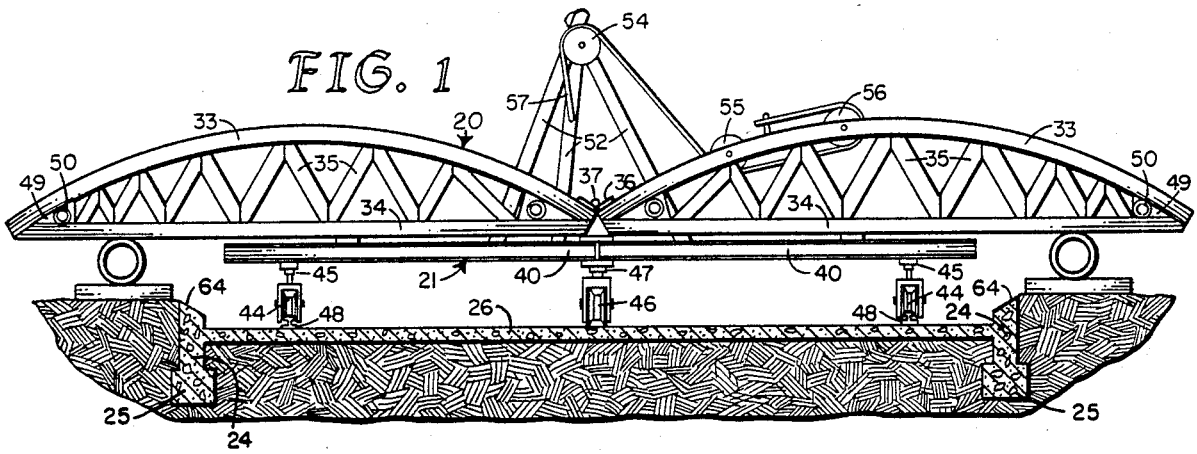
FIG. 2
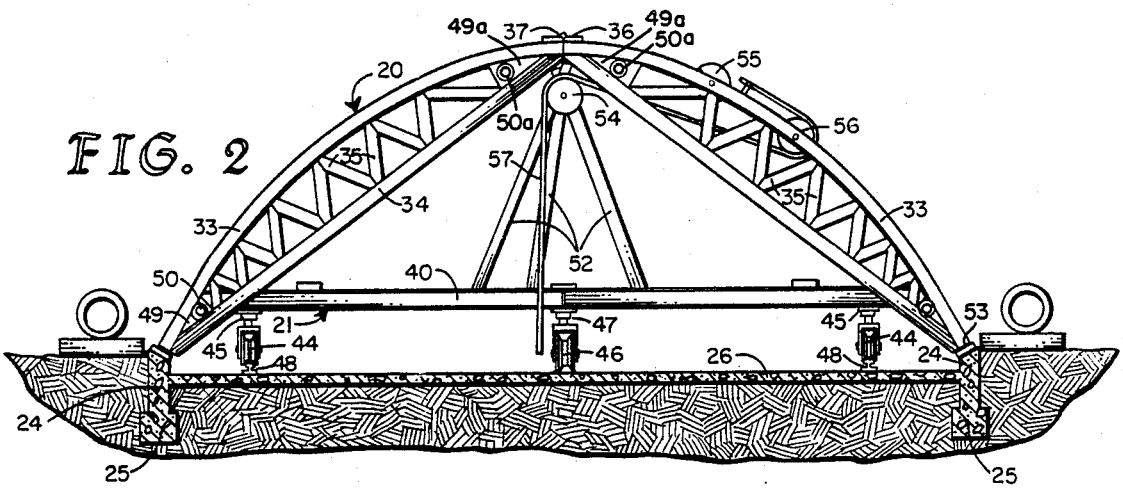
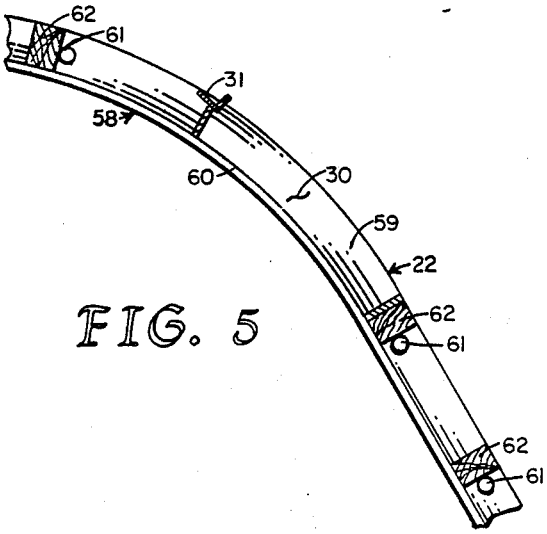
FIG. 5
FIG. 3
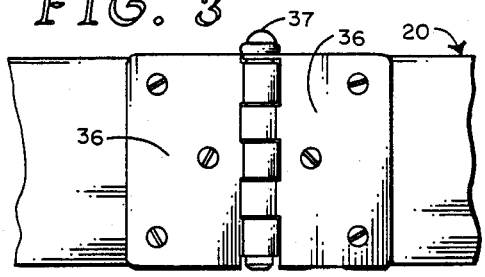

APPARATUS FOR FORMING CONCRETE STRUCTURES

BACKGROUND OF INVENTION

1. RELATED APPLICATIONS

There are no applications for patent related hereto heretofore filed in this or any foreign country.

2. FIELD OF INVENTION

My invention relates generally to semi-continuous forming of elongate arched concrete structures and more particularly to a form structure and method that provide secondary supporting structure for plastic concrete to allow removal of a primary forming member prior to setting of concrete formed thereover.

BACKGROUND AND DESCRIPTION OF PRIOR ART

The formation of concrete structures of an elongate arched type having a uniform cross-section by use of a movable or "slip" form has long been known in the concrete arts. With this type of structure as heretofore known, a form involved has provided the complete forming surface and it, in general, has remained in forming position until concrete formed thereover has set to a stage of being self-supporting. This process has made slip forming of such concrete structures a rather slow and often labor intensive process. Various modifications of the concrete involved in such processes have come to be known to expedite forming, such as the use of low slump, quick-setting cement mixes; gunite and similar sprayed mixtures that shorten the setting period; and modification of the primary setting reactions of the cement by thermal, chemical or other means. All of these modifications, however, retain the same essence as the basic process and still remain relatively slow and costly by requiring a form to remain in place for support until a concrete mass formed thereby is set sufficiently to be self-supporting. My invention in contradistinction provides a semi-continuous concrete forming process, with the benefits of slip forming, that uses a secondary support frame to support plastic concrete and does not require a primary forming member to remain in a forming position after the initial placement of concrete thereover and until that formed concrete is self-supporting.

With the present day rise in energy cost and the relative economics and physical characteristics of other materials, concrete has become a more desirable material for the formation of relatively small building constructions such as residential housing, sheds, garages and the like. Even with relatively insulative concrete, however, energy has become a significant enough factor in such structures of the modern day that thermal insulation is still desirable to aid in preventing excessive heat transfer to or from such structures. In general in the prior art when insulation has been used with concrete structures, it most commonly has been mechanically fastened to a pre-formed rigid surface, normally the interior. My invention provides rigid insulation material that is directly embodied in a concrete building structure itself to form a part thereof and also create a forming surface for the plastic concrete of the structure.

The primary forming member which supports an area being formed also provides access to it. This forming member is of a compound nature, pivotally interconnected in its medial part, to allow folding for convenient transport and storage. The forming member is mounted on a carriage so that it may be moved upwardly into a forming position and downwardly somewhat therefrom to allow horizontal motion of the forming structure relative to a structure being formed. Prior slip forming devices have generally provided a form that continuously maintained a forming surface against a structure being formed and were not movable away from a formed structure to allow or aid form motion relative to the formed structure.

My supporting frame structure remains in place after concrete placement to support the plastic concrete prior to setting. It provides a plurality of spaced, beam-like arches carrying rigid cross elements between adjacent arches to form a rectilinear supporting network. A plurality of rigid insulating panels are positioned over each of the cells defined by this supporting network to form a continuous surface for support of a plastic concrete mass formed thereagainst. The ends of horizontally adjacent panels may be a spaced distance apart to form a continuous channel above a supporting frame beam. The undersurface of this channel is covered so that when concrete is applied to the forming surface, an arch will be formed in the concrete structure between the ends of horizontally adjacent insulating panels to strengthen the structure and to incorporate those panels in the formed structure. Slip form systems of the prior art generally have not allowed formation of structures with beams or arches projecting from the formed surface and have not embodied insulation panels as an integral part of their internal structure.

A concrete structure may be formed with my invention as rapidly as desired, as the secondary supporting frame is maintained in place until the formed plastic concrete sets and becomes self-supporting. The primary frame may be moved as soon as a concrete surface is formed thereover. After concrete of a structure is self-supporting, the secondary framework is removed and the inner surface of concrete beams may be finished to cover indentations caused by the secondary support arches or irregularities therein. Forming structures of the prior slip form art generally have not provided separate forming and supporting members to allow such formation as accomplished with my invention.

Cementitious material from which a building is formed with my invention is preferably a reasonably low slump, fairly dry, quick setting and high strength material. Gunite is ideal as it allows placement by spraying with traditional equipment and does not require use of screeds or similar devices to maintain vertical position of plastic concrete on the forms. Ordinary low-slump concrete mixtures with normal filler materials, however, may be readily formed with my invention and they offer substantial economy over gunite type materials.

My invention resides not in any one of the foregoing features per se, but rather in the synergistic combination of all of them to create the structures claimed and the functions necessarily resulting therefrom.

SUMMARY OF INVENTION

My invention provides a forming system for settable cementuous materials forming elongate structures having uniform arch-like cross-sections. A primary forming member provides a plurality of spaced, parallel forming arches, each with an upper arched surface of some width and of the shape of the surface to be formed. The arches are carried in spaced parallel array for slight vertical motion on a wheeled cart that provides means for horizontal motion. The arches are of a compound, pivotally interconnected structure so that may be collapsed for transport and storage.

A secondary support member provides a plurality of support arches shaped and sized to fit immediately over the primary forming arches. A plurality of spaced cross elements is releasably supported between adjacent support arches. A plurality of rigid insulation panels is carried on each cell defined between adjacent cross pieces and support arches, with a space between the ends of each vertical column of insulation panels, not greater than the width of the arched surface of a primary forming member therebeneath.

Secondary support arches are positioned on the primary forming arches, cross elements established therebetween and panels positioned thereover to create a forming surface. Plastic concrete is established to uniform thickness over the forming surface and immediately after its establishment, the primary forming member is moved forwardly and the process repeated to form the next section of a structure. The plastic concrete is supported by the secondary forming structure that remains in place until the concrete sets and becomes self-supporting.

The principal forming member is lowered vertically relative to the carriage supporting it for horizontal motion and then, when properly repositioned, moved vertically upwardly to the surface to be formed. The rigid insulation panels creating the principal area of a forming surface remain in a concrete structure as a part of it, embedded between adjacent beams formed of cementitious material in the spaces between the vertical ends of the insulation panels.

The primary forming member includes a step-like element carried between the two adjacent forward arches to aid worker access during use.

My forming system is primarily intended for use in a structure having a pre-established floor and parallel spaced footing upon which an arched surface is supported at each side.

In creating such a forming structure and system, it is:

A principal object to provide a composite form for semi-continuous forming of concrete structures with a principal forming member to support an area during placement of plastic concrete and an associated, separable secondary supporting member to support plastic concrete after placement and prior to becoming self-supporting.

A further object to create such a forming system that uses rigid insulating panels as a forming surface and embodies those panels on the inner surface of a formed concrete structure.

A further object to provide such a forming system that allows the formation of elongate arched structures that have laterally extending concrete arches depending below the inner surface of the structure with insulation panels incorporated between such arches.

A further object to provide such a forming system wherein the primary forming member is supported on a carriage for both horizontal motion therewith and vertical motion relative thereto to allow the forming member to be raised and lowered to aid motion.

A further object to provide such a concrete forming system wherein both the primary forming arches and secondary support arches are of a compound nature so that they may be collapsed for transportation and storage.

A still further object to provide such a forming system that may form ordinary cementitions materials of the present day concrete arts embodying ordinary reinforcing elements.

A still further object of my invention to provide such forming structure and method that are of new and novel design, of rugged and durable nature, of simple and economic manufacture and use, and otherwise well suited for the uses and purposes for which they are intended.

Other and further objects of my invention will appear from the following specification and accompanying drawings which form a part hereof. In carrying out the objects of my invention, however, it is to be understood that its essential features are susceptible of change in design and arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout:

FIG. 1 is an orthographic front view of the primary forming member of my invention, supported in a partially formed building structure with arches in lowered position.

FIG. 2 is an orthographic front view of the structure of FIG. 1 raised to a vertical forming position.

FIG. 3 is an enlarged partial view of the hingeable interconnection of the medial portions a primary forming arch.

FIG. 5 is a somewhat enlarged, partial cross-sectional view through the structure of FIG. 4, taken on the line 5—5 thereon in the direction indicated by the arrows, showing details of window formation therein.

DESCRIPTION OF THE PREFERRED EMBODIMENT

My invention generally provides primary forming member 20 supported on carriage 21 for vertical motion and horizontal motion and associated with secondary supporting member 22 which cooperates to form concrete structure 23 in a semi-continuous fashion.

Figure 4:
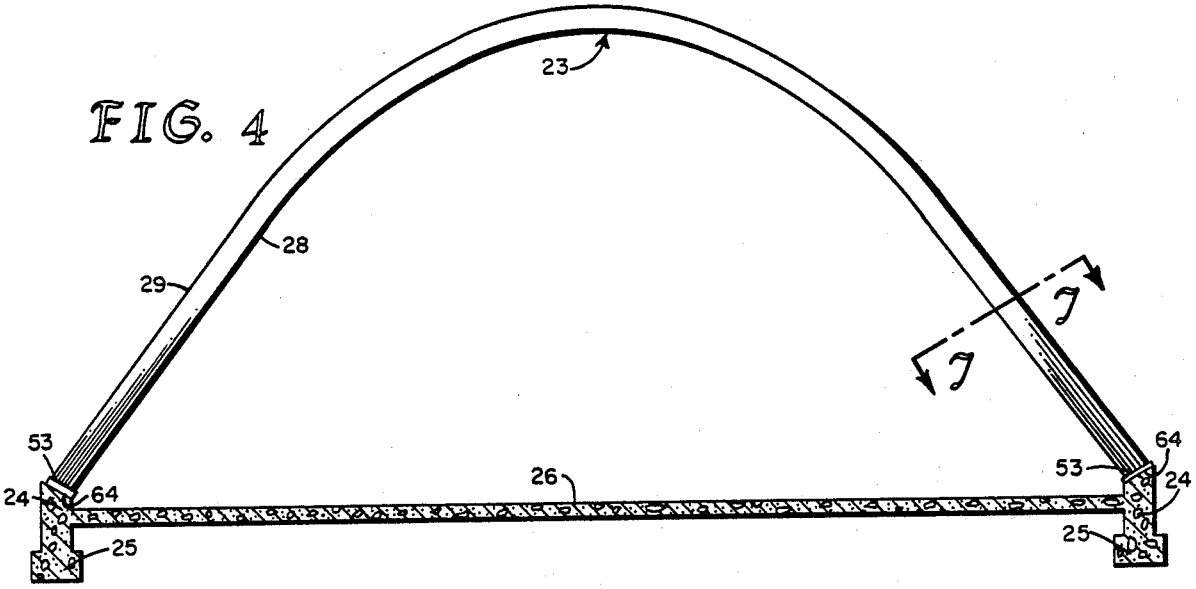
FIG. 4 is an orthographic front view of a structure formed by use of my invention.
Figure 7:
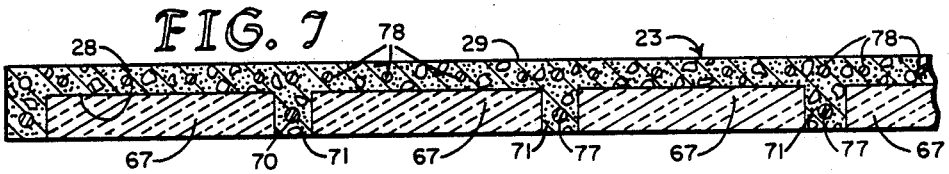
FIG. 7 is an enlarged, partial cross-sectional view on a normal plane through the structure of FIG. 4, taken on the line 7—7 thereon in the direction indicated by the arrows.
Figure 6:
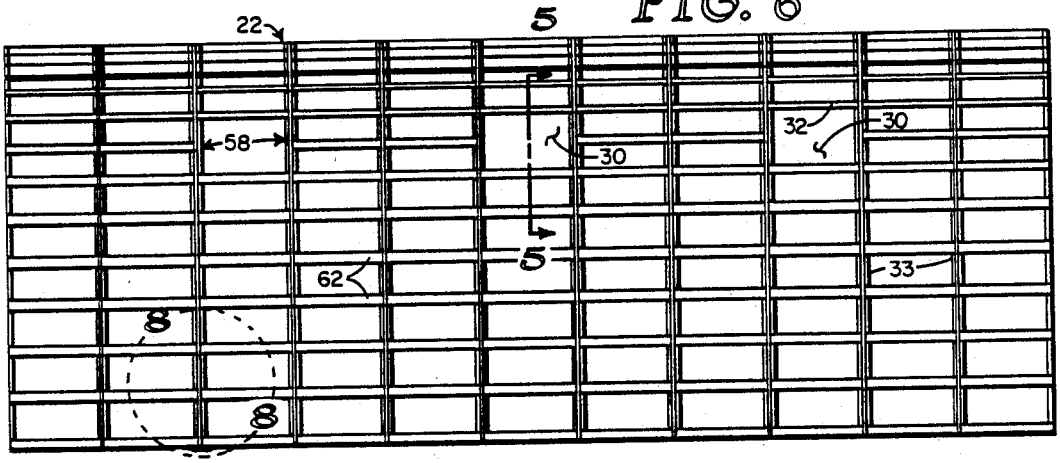
FIG. 6 is an orthographic side view of a section of the secondary support structure in place and with cross elements extending between support arches.
Figure 8:
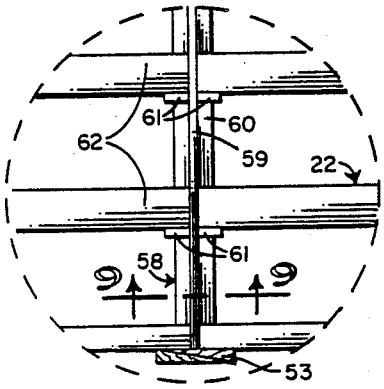
FIG. 8 is an enlarged partial view of a part of the structure of FIG. 6, about the base of one of the secondary support arches, as shown by the circle 8—8 thereon.
Figure 9:
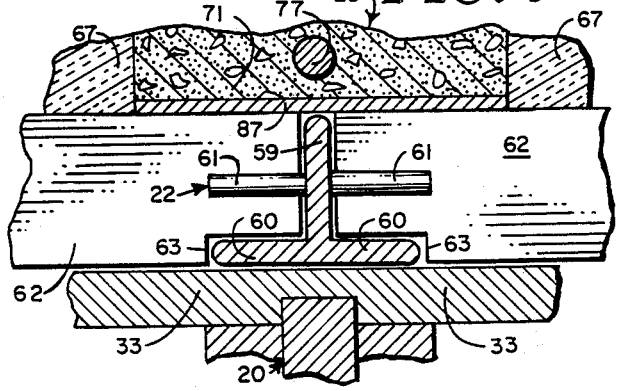
FIG. 9 is a substantially enlarged cross-sectional view through a secondary support arch and an associated primary forming arch of my invention, taken as on line 9—9 on FIG. 8 in the direction indicated by the arrows.
Figures 10, 11, 12:
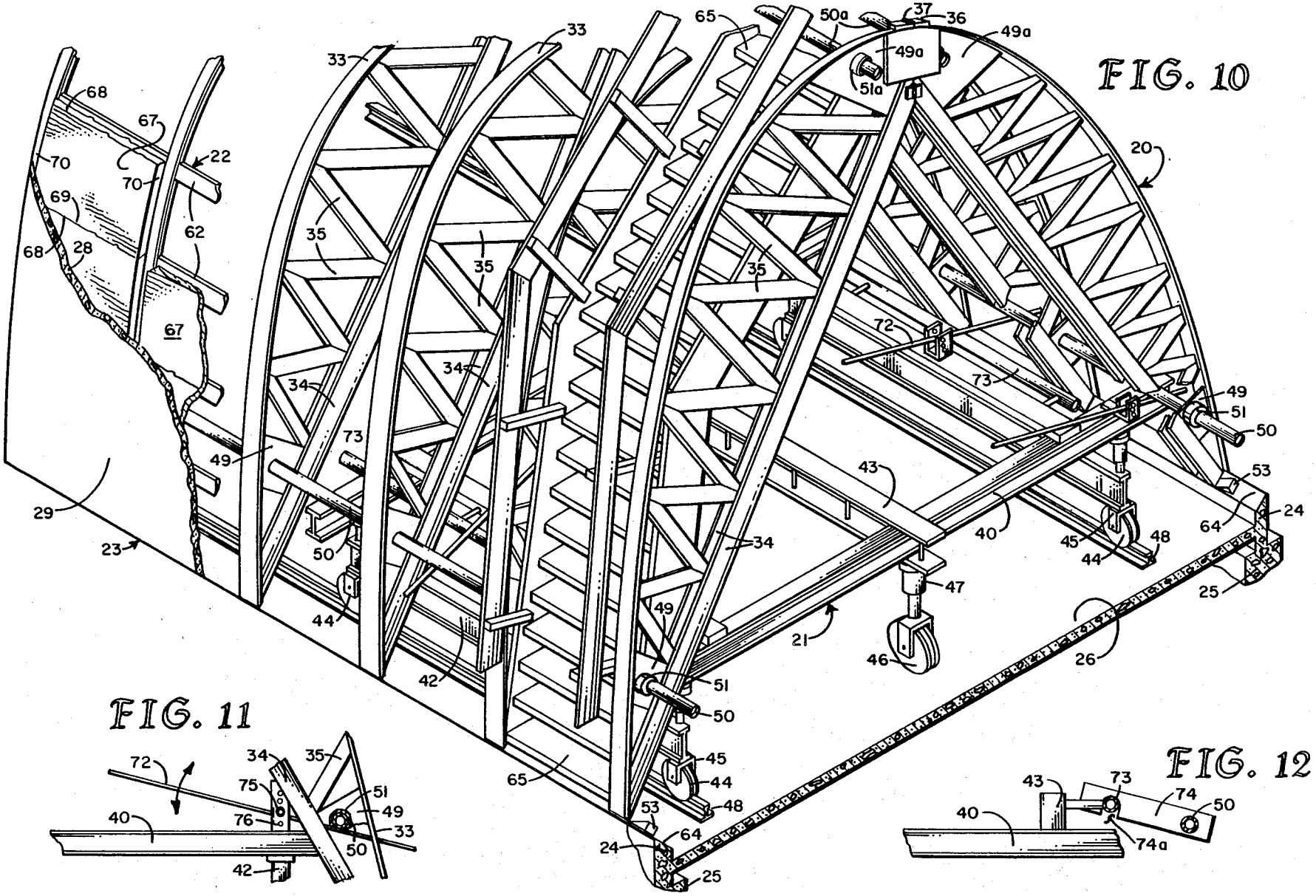
FIG. 10 is a partial, cut-away isometric view of a part of my forming structure in place in a partially formed concrete structure, showing various structural parts, their configuration and their relationship in more detail.
FIG. 11 is a partial orthographic view of the interconnection of the carriage and primary forming arches and the associated lever moving means, in lowered position.
FIG. 12 is a view of the structure of FIG. 11, but showing also the lever moving means.

As shown particularly in FIG. 4, concrete structure 23 comprises a foundation with low buttress-type side walls 24 extending upwardly from footings 25 supported in the earth therebeneath. Floor 26 communicates between buttress walls 24 throughout their length. The concrete structure to be formed by my invention is the elongate arched member 23 extending between the upper portions of side walls 24. This arched element 23 has a uniform cross-section throughout, and commonly will have the configuration of a parabola, because of the particular benefits that such a geometrical shape can provide in buildings, though the structure may have other arched shapes that have appropriate geometry to provide necessary strength, extend between walls 24, and extend upwardly a sufficient distance to form some type of a useful structure. Commonly, for effective use of my invention, the medial point of arched element 23 will be approximately fifteen to eighteen feet above floor 26. The arched element 23 is defined by internal surface 28 with associated depending arched beams 71 and external surface 29 and may include windows 30 as shown in FIG. 5, if desired.

If windows are to be provided in the arched member, they commonly will have peripheral flashing 31 to prevent water from entering between the adjacent surfaces of a window and the peripheral surface defining a hole therefore in my structure. Window 32 is of the ordinary type heretofore used in the construction arts and may be formed of common materials presently used for such purposes. A window is mechanically fastened within window hole 30 in the traditional fashion by bolts, screws, adhesion, or the like.

Arched member 23 of this building structure is the element which my invention is adapted to form.

Primary forming member 20 comprises four similar primary forming arches, each comprising upper arcuate element 33, lower cord 34 and medial interconnecting brace elements 35. These various arch elements are mechanically interconnected at their points of intersection by known means, normally nailing, gusset plates, or the like. Upper arcuate element 33 must have some width, that is, horizontal extension perpendicular to the arch cord, as it generally supports the undersurface of arched beams defined in a concrete structure formed thereover. Normally the width of this element should be at least approximately 6 to 8 inches. The entire forming arch structure is of a compound nature with arch element 33 pivotally interconnected in its medial portion by paired opposed hinge hasps 36 carried by each adjacent arch portion and joined by pivotally intercommunicating hinge pin 37. The forming arch need not necessarily be of a compound nature, but if it be, its transportation and storage is more convenient, as the element in general has dimensioning such as to make transport or contained storage difficult, if not impossible, in its erected state.

As illustrated in FIGS. 1 and 2, a plurality of forming arches are carried in spaced parallel array on carriage 21. This carriage provides an upper platform peripherally defined by similar forward and rearward beams 40, interconnected in spaced parallel array by similar lateral beams 42, with appropriate subframe elements 43 carried within and on the peripheral frame as required for the strength or support of other members. The carriage is supported for horizontal motion in an elongate direction, that is, perpendicular to side beams 42. Paired sets of lateral wheels 44 are carried by depending wheel supports 45 at each corner of the carriage, each lateral pair of wheels being so arrayed that a line extending between them is parallel to the lateral beams 42. Paired spaced medial carriage wheels 46 are journaled on medial wheel supports 47, depending from the medial portion of the frame, and again these wheels are arrayed so that a line through both medial wheels is parallel to lateral beams 42. For convenience, the wheel supports of all wheels are of a compound nature, embodying a screw or similar mechanism, to allow adjustable vertical positioning of wheels carried thereby relative to the upper platform carrying them. Preferably, but not necessarily, wheels 44, 46 are adapted to be supported for lineal motion along rails 48 and have a flanged configuration to prevent any lateral displacement from those rails.

The dimensioning of carriage 21 is such that its width is less than the distance between two buttress walls 24 which are to support a structure to be formed with my invention so that the carriage and supported forming structure may be appropriately positioned therebetween. The height of the upper portion of the carriage platform should be at least the height of the buttress walls so that when forming member 20 be in relaxed or transport mode it will be carried at or above the tops of the buttress walls 24, as the forming member will extend laterally therebeyond. Normally my carriage will be sized so as to support four axially spaced arches, though varying numbers may be used as desired. Four arches allow formation of concrete in two tiers between three secondary arch supports which is about as much as can be conveniently accessed by workmen working from an access tier.

The primary forming arches are interconnected, to maintain positional integrity, by filets 49 in the outer lateral parts of each arch structure. These fillets on each side pivotally carry elongate pipes 50 extending in axially aligned orientation therebetween. Collars 51 are carried by the pipes 50 on the sides of the fillets to maintain appropriate lineal positioning of the forming members. The medial upper portions of the primary arches preferably are similarly interconnected, near their hinged portions, by elongate pipes **50*a* extending between fillets 49*a* of the arch elements with collars 51*a*** again carried on the pipes laterally of each arch element to maintain alignment.

The entire forming member is mounted for limited vertical motion on carriage 21. In the instance illustrated arch connecting pipes 50 and inwardly adjacent parallel carriage pipes 73, carried by the lateral portion of the carriage platform are pivotally interconnected by brackets 74. These brackets must have releasable interconnection with one pipe element, in the case illustrated with carriage pipes 73, to allow lateral motion of the end parts of the arch elements when they are lowered. This is accomplished in the instance illustrated by notches **74*a* defined in connecting brackets 74. Plural levers 72 pivotally communicate between the carriage frame and connecting pipes 50 to raise or lower the forming member a few inches relative to the carriage. Levers 72 are releasably positionally maintained, especially in either extreme position, by pins 75 carried by vertical fastening brackets 76** supported on the carriage platform.

The only requirement of this structure is to move the forming arches through a limited vertical distance relative to the carriage. Means that accomplish this purpose other than the lever mechanism disclosed well may serve the purposes of my invention, such as screw mechanisms, jacks, hydraulic cylinders and the like.

Carriage 21 also provides a system for erecting the primary forming arches. This system comprises tripod 52 carried by secondary frame supports of the carriage and extending a spaced distance above the carriage platform, but not so far as the elevation of the erected forming arches to avoid interference with a structure to be formed. In its uppermost portion the tripod journals lifting pulley 54. Similar inner arch pulley 55 and outer arch pulley 56 are journaled respectively on the medial inner and outer portions of at least one of the halves of the primary forming arches. Flexible cord 57 is carried in a continous course about the pulleys, passing upwardly over top pulley 54 and then downwardly under first inward pulley 55 and thence under outer pulley 56 and thereover to be thence fastened to the arch, as illustrated, so that when the free medial end of the cord is pulled downwardly, the forming arch structure is lifted upwardly to cause it to move from a relaxed horizontal position into a fully formed position such as illustrated in FIG. 2. One laterally positioned pulley, horizontally below top pulley 54, might accomplish this motion but not so easily or conveniently as the two pulleys described.

For convenience a stair structure 65 is preferably provided between the two adjacent forward forming arches to aid worker access. This structure is of ordinary construction and may be either permanently or releasably fastened between the two forward arches. The structure is not necessary to my invention but provides a substantial amenity as access to the forming area may be otherwise difficult and generally must be provided by some additional secondary structure.

Secondary support member 22 provides a plurality of arch elements 58 formed, in the instance illustrated, from elongate rolled steel beams of a "T" cross-sectional shape with body 59 of the "T" extending normally outwardly from the structure in a vertical plane and arm 60 extending in a horizontal orientation. The shape and size of the support arches is such that arm 60 of the "T" fits immediately adjacent the upper surface of an arcuate element 33 of a forming arch of the primary forming member. The support arches may be of a unitary construction, but preferably are compound and formed in two sections that may be releasably joined to allow ease of storage and transport. If compound, the support arches must be rigidly interconnected, by appropriate mechanical fastening (not shown) accomplished as heretofore known, to form a structure of appropriate strength and rigidity, similar to that of a unitary element, as these elements are required to support substantial loads.

Each support arch carries a plurality of spaced cross-support lugs 61 extending perpendicularly outwardly from body portion 59 of the "T" element to cooperate with similar lugs of an adjacent support arch to support rigid cross-pieces between two adjacent support arches. Cross-support lugs 61, in the instance shown, are cylindrical but this shape is not critical. The spacing between lugs is generally uniform and dictated by the size of insulating panels that are to be used in my form structure. In general, the distance between the same portions of two adjacent lugs should be substantially the same as the dimension, in an upward direction, of particular insulating panels to be used so that the horizontal joints between insulating panels may fall upon the surface of cross-elements carried by the cross-support lugs.

A plurality of similar elongate, rigid cross-supports 62 extend between adjacent support arches to maintain support arch spacing and aid in supporting rigid insulation panels. Each cross-support is maintained between adjacent forming arches immediately upwardly adjacent paired opposed cross-support lugs of those arches. A cross-support will be maintained in this position by gravity because of the configuration of the support arches and the underlying forming arches. The length of cross-supports, and consequently the spacing between adjacent support arches, must be related to the length, that is the horizontal dimension, of insulating panels that are to be used with my forming system. In general, the length of the cross-supports will be approximately four inches longer than the length of insulating panels so that there will be a space between the ends of adjacent vertical columns of panels to allow formation of a concrete arched beam 71 in such space to strengthen a formed structure and embody insulating panels therein. Preferably the cross-support length will be approximately 36 inches to create beams about 36 inches on center and accept panels approximately 32 inches wide (horizontal dimension). The end portion of each cross-support defines a notch 63 in its lower end portion so that the cross-support may fit upon the upper surface of a primary arch element 33 with the horizontally extending arm portion of a support arch positioned within notch 63 to allow such placement. The cross-supports are formed of some rigid, reasonably durable material, in the instance illustrated by wood cleats about 1.75 inch in cross-sectional dimension.

Insulating panels 67 provide rigid rectilinear sheets defined by top edge 68, bottom edge 69 and similar side edges 70. The insulation panels preferably have a thickness of approximately 4 inches, but all dimensions obviously may be varied, as desired, to fulfill the purposes of a particular structure. The material of which the insulation panels are formed should have desired thermal insulating properties and should also provide appropriate strength and rigidity to support a plastic concrete mass carried thereon when the panel is supported about its peripheral edges. The material I prefer for this purpose is foamed polystyrene of a smaller cell size and medial density, but other materials having similar physical characteristics would serve the purposes of my invention. It is to be noted that the depth of the arched beams below a formed concrete surface will be determined by the thickness of the insulating panels.

Figure 15:
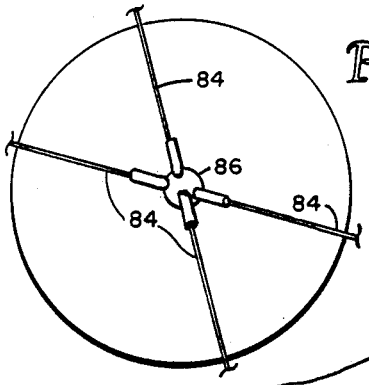
FIG. 15 is a partial view of the medial cable connector of the two carriage, arch support system.
Figure 14:
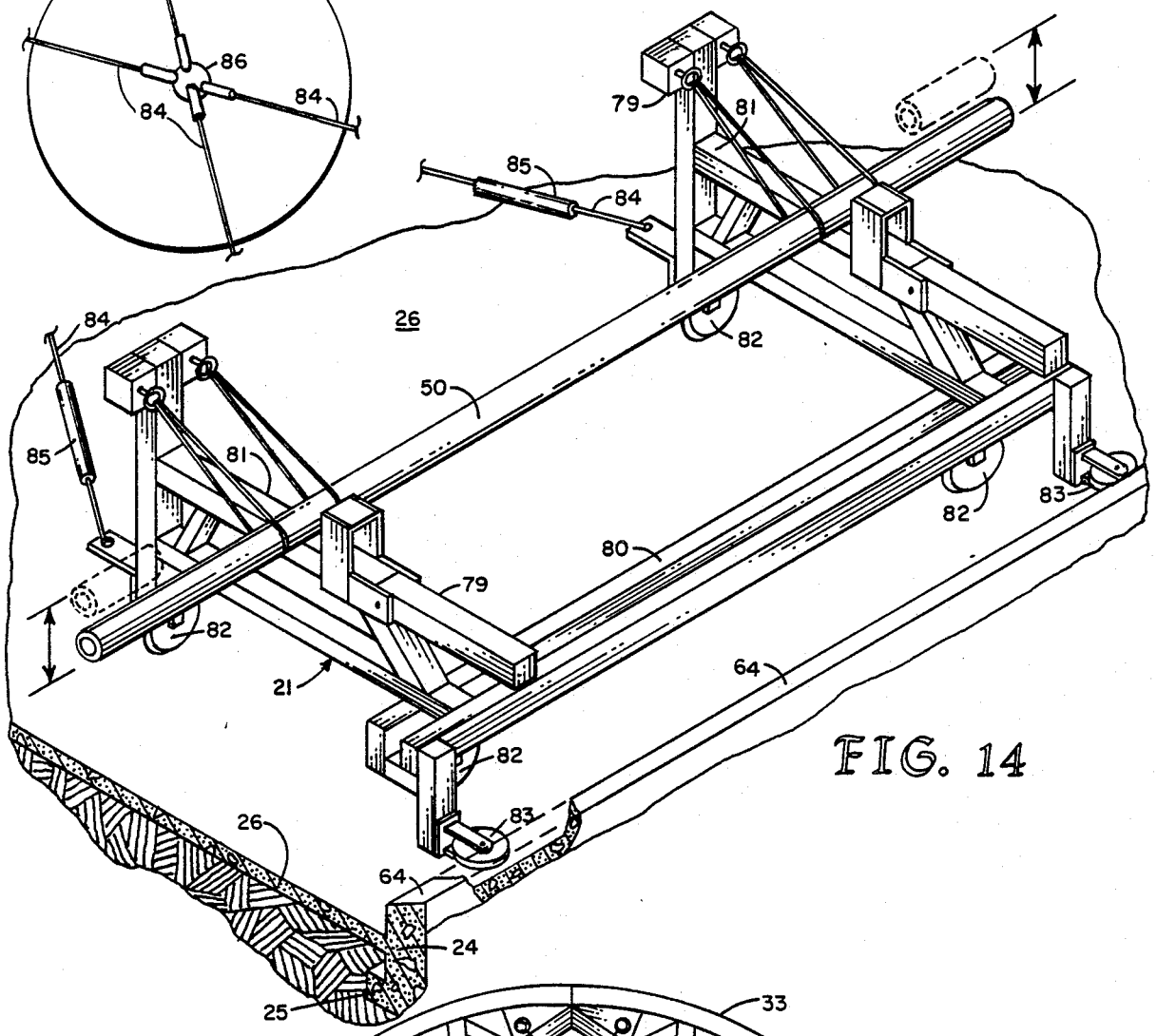
FIG. 14 is an enlarged isometric view of one of the carriages of FIG. 13, showing its structure in more detail.
Figure 13:
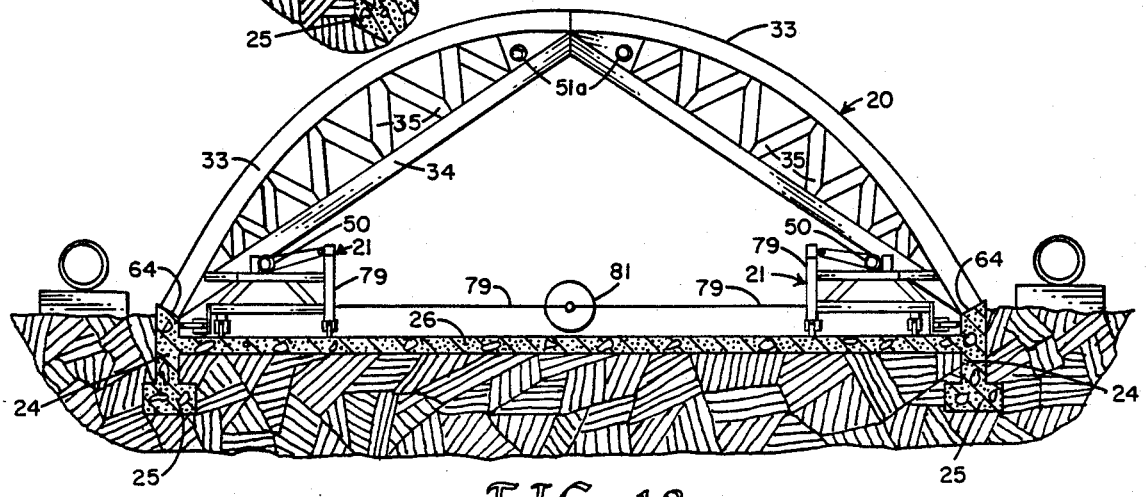
FIG. 13 is a vertical end view of a species of my invention using two spaced carriages for support of the primary forming arches.

A species of carriage 21 is shown in FIGS. 13, 14 and 15, where it is seen in essence to provide two spaced lateral carts 79. Each lateral cart is formed by peripheral frame 80 with upwardly extending primary frame support 81 to support pipes 50 in fashion similar to the primary cart. The secondary cart is provided with plural depending wheel structures 82, each again preferably being of a compound nature with means for vertical adjustment. Two horizontal positioning wheels 83 extend laterally from the lateral part of the cart to contact an adjacent parapet wall to maintain cart position.

Crossed guy wires 84 extend between opposed corners of the two carts to maintain them in a parallel relation. Preferably guy wires 84 each have turnbuckles 85 for tension adjustment and all communicate in their medial portion with common connector 86. The wheels of this form of carriage may be flanged if desired for rail support, but generally this is not necessary and may not even be desirable. This form of cart structure functions in fashion similar to the primary species but is somewhat less cumbersome.

Having thusly described the structure of my invention, its use may be understood.

Firstly, a base structure comprising planar floor 26 with side walls 24 along two opposed parallel sides is created, as illustrated particularly in FIG. 4. Normally floor 26 will be supported directly on the earth therebeneath and the buttress side walls will be supported in the earth by footing structures 25. The upper portions of the side walls have upper surfaces 64 angling in a downward and inward direction to react against and absorb thrust created thereon by a building arch of my construction. This concrete base portion of a building is formed in the ordinary fashion, with appropriate reinforcing, according to the methods of the present day concrete arts.

To use my invention with the primary species of carriage, two spaced parallel rails 48 are positioned on floor 26 to support carriage 21 and provide for its motion in a lineal direction parallel to the side walls. The horizontal positioning of these rails will be dictated by the spacing of wheels on the carriage and also by the position of the form structure on the carriage so that the primary forming member will be carried in a fashion to extend between the buttress walls, and particularly the two angled top portions 64 thereof. A forming member will be uniquely sized and configured for a particular building and if different sizes or shapes of buildings be required, particular forming members generally must be created for each according to the foregoing specifications. One carriage structure, however, may quite readily support primary forming members varying through most any shape and quite a wide range of sizes.

The vertical positioning of the carriage is then adjusted so that it will position the primary forming members, when erected, so that their bases will extend between the angled surfaces 64 of the two side walls. The height of the carriage may be adjusted by raising the height of rails 48 above a supporting floor by appropriate blocking or by raising or lowering the carriage frame relative to its wheels by means of adjustable interconnecting linkage.

When initially positioned, my carriage will be on its supporting rails at one end of the base structure and its primary forming members will be in a relaxed or downward position with their lower cords resting on the carriage and extending perpendicularly past the side walls. There normally will be four spaced primary forming arches supported by the carriage to allow three tiers between the forming arches, one for a set of steps for worker access between the forward two arches and the other two for formation of two tiers of concrete sections rearwardly of the steps.

The primary forming arches are erected by pulling the free end of cord 57 downwardly so that cord firstly raises inward pulley 55 upwardly some distance and when that pulley reaches the level of top pulley 54, the cord then will raise outer pulley 56, which is at a lower elevation, upwardly until the arch is completely erected. At this point, the arch cords are interconnected to form a rigid forming arch structure, supported in their lateral parts on the carriage with arch pipes 50 interconnected to cart pipes 73. The carriage is then lineally positioned so that the ends of the rearwardmost primary forming arch are coincident with and extending between the rearwardmost portions of both opposed side walls. The forming arches must necessarily be a spaced distance above the side walls to allow downward motion for removal, and are so maintained by wedges 53 supported on the side walls. If rigid arches are used they may be positioned in similar fashion by crane or possibly manually, depending on size.

With the primary forming structure in position, secondary support arches are placed on the three rearwardmost primary forming arches and positioned in a medial position relative thereto with proper spacing between adjacent support arches. Cross-supports 62 are positioned between the support arches immediately above each opposed pair of cross-support lugs on adjacent support arches and are there positionally maintained, without further fastening, by action of gravity. Insulating panels 67 are then positioned in vertically aligned rows between each opposed pair of support arches. Since the panels are generally not so long as the distance between an opposed pair of support arches, there will be a space left at each end between horizontally adjacent insulating panels.

The panels normally will be positionally maintained by reason of gravity, though they may be temporarily mechanically fastened to the cross-members by small nails, clips or the like, as occasion may require. The ends of the insulting panels are aligned to create a space therebetween that is symmetrical about the support arch which is positioned under that space, so that a concrete arch may be created at that position and supported from its undersurface by the upper surface of each primary support arch. The space between insulating panel ends may carry a relatively thin forming strip 82 of some rigid material such as sheet metal or plastic, so that the forming strip will form a smooth continuous undersurface for the beam structure. This element, however, is not necessary.

If desired, structural steel may be embedded in the concrete building shell by placement spacedly adjacent the form structure. Normally, an elongate, cylindrical rebar rod 77 will be placed in the top and bottom portions of the arched beam part of the structure and commonly wire mesh 78 will be included in the overall building shell. If rebar be used in buildings under a seventy-five foot span, I prefer a number four continuous piece of rebar in the bottom of each beam structure and a number three piece of rebar in the top portion, as this latter area has somewhat less stress. I prefer to use 6 by 6 inch, number ten wire reinforcing mesh in a continuous pattern over the entire arched cementitious surface. All of the reinforcing material should be positioned so that it is carried in a medial position within the concrete mass to be formed so as to be protected by that concrete mass and be of most benefit. The reinforcing material may be placed and positionally maintained in the traditional fashion by means of temporary supports, blocking, and the like.

After my forming element is established as aforesaid, and reinforcing material placed as desired, plastic cementitious material is established over the forming area defined between the last three primary forming arches. I prefer that the cementitious material be a low-slump, quick-set type concrete placed by traditional methods. This type of concrete provides a relatively low cost, high-strength material that will maintain its position against forces of gravity after placement without creeds or other secondary support. The material sets relatively rapidly, in a preliminary set at least, and this further aids the support process. Sprayed gunite is well suited to the purposes of my invention and other specialized cementitious mixtures work well, but they generally are relatively expensive.

The cementitious material may be conveniently placed by a workman gaining access to the forming area from the step portion between the two forward arches of the primary forming member. The cementitious material is preferably placed to a depth of at least approximately 1.5 to 2 inches. With normal insulation, this will leave an arched beam extending downwardly approximately 4 inches below the undersurface of the cementitious shell. The exposed upper surface of the cementitious material after forming may be left rough as it is formed or, if desired, it may be finished by appropriate tooling as heretofore known in the concrete forming arts.

After the sections over the primary forming structure are formed, that forming structure is lowered slightly from its forming position by removing its supporting wedges and lowering relative to the supporting carriage or with that carriage. The carriage is then moved forwardly to a position such that the rearwardmost primary forming arch is under the forwardmost support arch 58 over which concrete is formed. In this position, the primary forming structure is again moved upwardly to a forming position and the same process repeated to form the next two sections of a structure.

The primary forming structure may be removed as soon as cementitious sections formed over it in a particular position are placed and formed, as the still plastic concrete mass will be supported by the combination of insulating panels and secondary supporting frame that remain in place. An entire building structure may therefore be formed as rapidly as the primary forming member may be moved and concrete placed. Generally the arched surface in a building 40 feet wide and 60 feet long may be quite conveniently formed by five workman in a one day period by using the apparatus and methods of my invention.

After the arched element is formed, the primary forming arches are moved from under a building structure and lowered on the carriage supporting them for transport or storage. After the concrete of the arched element is set to appropriate strength, generally in one to three days, the secondary supporting frame is removed and the building will then be self-supporting and may finish curing without auxiliary support. When that secondary frame is removed, support arches and cross-supports will be beneath the concrete surface and will be removed from it. Rigid insulating panels will be carried between adjacent arched beams and will be thereby embodied within the structure and remain a part of it to provide insulation on the undersurface of the building between its arches.

Once the building's arched shell is formed, its ends are formed by ordinary construction methods from wood, masonry, flat formed concrete or other standard materials and methods as heretofore known, to provide a completely enclosed structure with appropriate orifices.

In the use of my invention, window holes or other orifices may be created in a concrete shell structure if desired. The cross-section of FIG. 5 shows one method of forming a window structure 30 in an arched concrete surface. Such orifices may be fitted with windows, flashed and weather proofed according to the principles heretofore known and commonly used in the construction arts.

It is to be noted from the foregoing description that my invention provides a continuous type of concrete formation but yet forms a structure having a relatively thin uppermost peripheral arched shell with depending spaced parallel arches defined at spaced distances parallel to the axis of the building. It is further to be noted that the concrete structure formed may embody ordinary reinforcing materials that have been commonly used in the such structures in the prior art.

It is further to be noted that my apparatus may be used with many cementitious materials and, in fact, even with ordinary low slump concrete. In the latter instance, however, the concrete may have to be placed from a cement pump and it is possible in areas of substantial vertical slope, that the concrete may have to be positionally maintained by screeds until a preliminary set is established, depending upon the particular configuration of a building shell and the particular nature of the cementitious material used.

It is further to be noted that, although my structure is described in the foregoing specific embodiment for use in a curvilinear arch-type configuration, it well may be used with various other elongate configurations that have a uniform cross-section. In fact, it might even be used in structures having a curvilinear axis, so long as the curve of the axis be not too severe. The particular form of building illustrated is a parabolic arch which is especially useful because it provides desirable features of parabolic geometry such as allowing placement of mechanical systems including lighting and heating at the focal line of the shell so that their radiant products tend to be dispersed in a vertical fashion to provide more uniform distribution, according to principles heretofore known.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent and

What I claim is:

1. A forming system for concrete structures of substantially uniform arched cross-section comprising, in combination:

a primary forming member having a plurality of interconnected spaced, parallel primary forming arches positioned in linear array, each primary forming arch having an upper arcuate element;

a carriage supporting said primary forming arches and having first means for motion of the carriage in a direction perpendicular to a plane parallel to the forming arches and second means for vertically moving said forming arches vertically relative to said carriage;

a secondary supporting member including a plurality of rigid support arches having the shape of the upper surface of the arcuate elements of the primary forming arches and supported thereon, means to releasably support a plurality of rigid elongate cross-supports between adjacent support arches, and a plurality of rigid cross-supports extending between and supported by adjacent support arches; and a plurality of rigid insulating panels supported by the cross-supports to provide a concrete forming surface, said rigid insulating panels having a length less than the distance between adjacent support arches to create a channel between vertical columns of insulating panels to allow formation of arches between adjacent panel columns against the support arches to incorporate the insulation panels therebetween and provide depending arches in a formed structure.

2. A forming system for arched concrete structures having substantially uniform cross-section with spaced depending arches, comprising in combination:

a primary forming member including a plurality of forming arches interconnected in spaced parallel relationship and carried by at least one carriage having first means for motion of the carriage over a supporting surface in a direction perpendicular to the planes of said forming arches and second means for vertically moving said carried interconnected forming arches; and a secondary supporting member supported on the primary forming member and having a plurality of support arches, configured to be supported immediately upwardly adjacent each primary forming arch, each support arch having means for supporting a plurality of rigid cross-supports in cooperation with an adjacent support arch to form a plurality of cells, each cell peripherally supporting a rigid insulating panel to form a concrete forming surface, said insulating panels having a horizontal dimension less than the distance between adjacent support arches to define a channel between vertical columns of insulating panels in which a depending arch may be formed against a support arch.

3. The system of claim 2 wherein:

the primary forming arches are of a compound nature with hingeably interconnected arcuate elements to allow downward folding for transportation and storage; and the carriage carrying the primary forming arches has a medial tripod extending upwardly therefrom and carrying a pulley carrying a flexible cord extending and fastened to a lateral portion of at least one of said primary arches to aid in the erection thereof by pulling an end portion of the cord downwardly.

4. The system of claim 2 wherein:

the two adjacent forward forming arches a step structure extending therebetween to aid workers' access to the form structure during use.

5. For use in a semi-continuous concrete forming system wherein plastic concrete is formed over a primary forming member comprising an arched element including a plurality of spaced primary forming arches and the primary forming member thereafter moved to form the next adjacent concrete section, a secondary supporting system comprising, in combination:

a secondary supporting member including a plurality of secondary support arches of the same configuration as the primary forming arches, each support arch having means to support cross-supports between spaced adjacent support arches; and a plurality of rigid panels carried over and supported by the cross-supports to form a supporting surface for plastic concrete, said secondary supporting member remaining in place, after removal of the primary forming member, until plastic concrete formed thereover is set, and said rigid panels being formed of insulating material and having a horizontal length less than the distance between adjacent support arches to form a channel between the end portions of horizontally adjacent rigid panels for formation of an arched concrete beam against a support arch to incorporate said rigid panels as a part of a cementitious structure.

* * * * *